US007237864B2

(12) United States Patent
Sarmast et al.

(10) Patent No.: US 7,237,864 B2
(45) Date of Patent: Jul. 3, 2007

(54) FLUID EJECTION DEVICE IDENTIFICATION

(75) Inventors: Sam Michael Sarmast, Vancouver, WA (US); Matthew A. Shepherd, Vancouver, WA (US); Maxwell S. DeHaven, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 252 days.

(21) Appl. No.: 10/774,322

(22) Filed: Feb. 6, 2004

(65) Prior Publication Data

US 2005/0174370 A1 Aug. 11, 2005

(51) Int. Cl.
*B41J 29/393* (2006.01)
*B41J 2/175* (2006.01)

(52) U.S. Cl. ..... 347/19; 347/86

(58) Field of Classification Search ..... 347/19, 347/86

See application file for complete search history.

(56) References Cited

U.S. PATENT DOCUMENTS 4,872,027 A 10/1989 Buskirk et al.
4,953,751 A * 9/1990 Shannon ..... 222/14
4,979,639 A * 12/1990 Hoover et al. ..... 222/1
5,363,134 A * 11/1994 Barbehenn et al. ..... 347/49
5,699,091 A * 12/1997 Bullock et al. ..... 347/19
5,757,394 A * 5/1998 Gibson et al. ..... 347/19
6,019,461 A * 2/2000 Yoshimura et al. ..... 347/86
6,039,430 A * 3/2000 Helterline et al. ..... 347/19
6,128,098 A * 10/2000 Kamada et al. ..... 358/1.8
6,161,915 A * 12/2000 Bolash et al. ..... 347/19
6,193,347 B1 2/2001 Askeland et al.
6,199,969 B1 3/2001 Haflinger et al.
6,257,690 B1 7/2001 Holstun
6,267,463 B1 7/2001 Paulsen et al.
6,315,381 B1 11/2001 Wade et al.
6,325,483 B1 12/2001 Harbour et al.
6,390,585 B1 5/2002 Schiaffino et al.
6,398,330 B1 6/2002 Chua et al.
6,449,532 B1 * 9/2002 Nicol ..... 700/233
6,460,962 B1 10/2002 Dietl et al.
6,476,928 B1 11/2002 Barbour et al.
6,488,352 B1 12/2002 Helterline et al.
6,568,783 B2 * 5/2003 Hu et al. ..... 347/19
6,568,785 B1 * 5/2003 Edelen et al. ..... 347/19
6,575,548 B1 6/2003 Corrigan, III et al.
6,621,676 B2 9/2003 Barton et al.
6,629,789 B2 10/2003 Kawatoko
6,665,770 B2 12/2003 Koga
6,736,477 B2 * 5/2004 Tsuruoka ..... 347/19
6,871,933 B2 * 3/2005 Li ..... 347/19
2004/0183844 A1 * 9/2004 Anderson et al. ..... 347/12
2005/0099445 A1 * 5/2005 Silverbrook ..... 347/19

OTHER PUBLICATIONS

HP Patent Application, "Variable Drive for Printhead", William S. Eaton, U.S. Appl. No. 10/670,061, Sep. 24, 2003.

* cited by examiner

*Primary Examiner*—Stephen Meier
*Assistant Examiner*—Rene Garcia, Jr.

(57) ABSTRACT

A fluid ejection device and a method for identifying a fluid ejection device are provided by determining first identification information and based upon the first identification information, querying one or more elements on the fluid ejection device that include second identification information. Then determining the second identification information based upon the query and a plurality of operating of parameters of the fluid ejection device based upon the first and second identification information.

25 Claims, 6 Drawing Sheets

FLUID EJECTION DEVICE IDENTIFICATION

BACKGROUND

A conventional inkjet printing system includes a printhead, an ink supply which supplies liquid ink to the printhead, and an electronic controller which controls the printhead. The printhead ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium. The operation of the printhead is a function of various parameters, including but not limited to, ink type, number of nozzles in the orifice plate, spacing between the nozzles, data transfer rates, among others. In addition, different print cartridges may operate according to different protocols. As such, the printer must utilize the protocol of the print cartridge in order to achieve proper ejection of ink and to prevent damage to the print cartridge.

In an ink jet printer it is desirable to have several characteristics of each print cartridge easily identifiable by a controller. Ideally the identification data should be supplied directly by the print cartridge. The "identification data" provides information to the controller to adjust the operation of the printer and ensures correct operation. The identified characteristics include, but are not limited to, ink color, architecture revision, resolution, number of nozzles in the orifice plate, spacing between the nozzles, among others as described in the previous paragraph. In addition to the above characteristics of the print cartridge, it may be further desirable to characterize each print cartridge during manufacturing and to supply this information to the printer. In this manner, it would be possible compensate for variations in energy supplied to the resistor array in the integrated circuit, ink drop volume, ink drop velocity, missing nozzles, and various other manufacturing tolerances or defects such as orifice plate misalignment or non-planarity and angled orifice holes.

Print cartridges and printers employ electrical interconnects between the cartridge and the printer, so that operation of the print cartridge can be controlled by the printer. The electrical interconnects can be in the form of an interconnect array having a plurality of discrete interconnect pads. The use of replaceable print cartridges in inkjet printers allows the possibility that a user may install or attempt to install a replacement print cartridge that is not designed for use with the user's particular printer or with the particular chute of the particular printer. The installation of a print cartridge into an incorrect chute in a printer can result in dangerous situations where electrical circuits are energized incorrectly, e.g. using the improper protocol or improper signal magnitudes, causing damage to the print cartridge, the printer, or both. This damage may cause substantially loss for users. Therefore, consideration must be given to the prevention of use of a print cartridge that will not operate properly in the chute or printer.

One solution to prevent incorrect use of a print cartridge in a printer is to make each print cartridge with a physically different shape from other print cartridges for other printers or chutes, so that there is no possibility of a printer accepting an incorrect cartridge. This solution requires very different production lines for print cartridges and printers and is consequently costly to implement. Another solution is to have similar print cartridges, but provide unique physical keys on the cartridge and printer so that an incorrect cartridge cannot be inserted into a printer. This solution can be defeated by a user who removes or modifies the physical keys. Yet another solution is to have physically similar print cartridges, and to make sure that the positions of the interconnect pads do not overlap between cartridges intended for different printers or different chutes. This solution becomes unreasonably difficult to implement, as eventually interconnect pad positions will overlap as the number of interconnect pads increases (increasing performance) and/or the size of the interconnect array decreases (decreasing cost).

In addition, it is possible that different types of print cartridges are capable of being inserted into a single chute. In this instance, it is necessary to identify the operating parameters of the print cartridge that is inserted and operate that print cartridge accordingly. To do this, a number of parameters of the print cartridge need to be identified.

As the different types of cartridges and their operating parameters increase, there is a need to provide a greater amount of identification information. At the same time, it is not desirable to add further interconnections to the flex tab circuit to carry such identification information.

BRIEF DESCRIPTION OF THE DRAWINGS

Features of the invention will readily be appreciated by persons skilled in the art from the following detailed description of exemplary embodiments thereof, as illustrated in the accompanying drawings, in which.

DETAILED DESCRIPTION OF THE DRAWINGS

Figure 1:
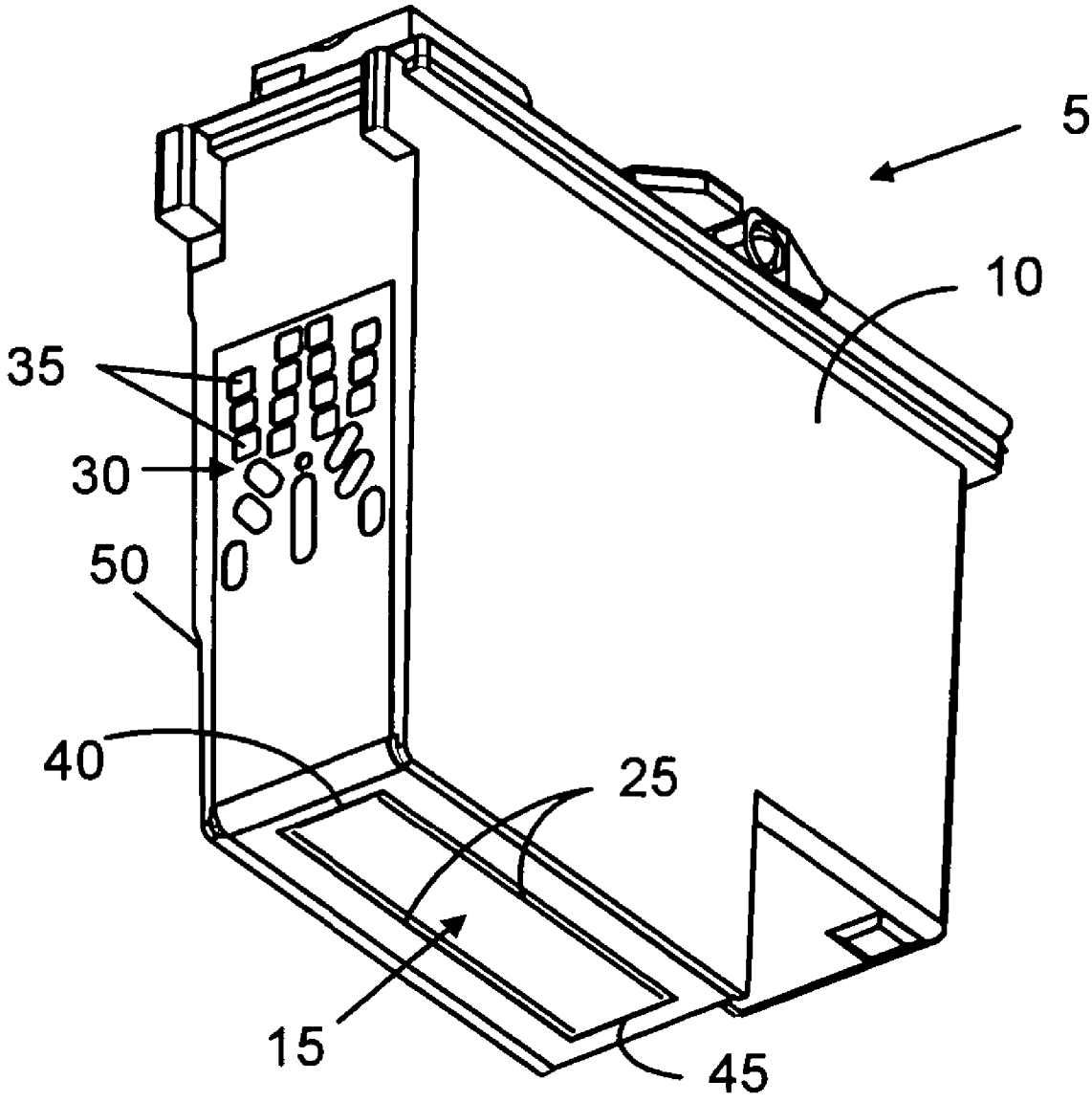
FIG. 1 illustrates a fluid ejection device according to one embodiment.

In the following detailed description and in the several figures of the drawing, like elements are identified with like reference numerals.

FIG. 1 illustrates an exemplary embodiment of a replaceable fluid ejection device 5. Fluid ejection device 5, in this example a print cartridge for a printer, comprises a fluid reservoir 10, e.g. an ink reservoir, and a die 15, a print head. Fluid reservoir 10 stores a supply of a fluid, which may be refilled or replenished as necessary. Die 15 functions to eject fluid onto a print medium, such as paper, mylar, plastic, fabric, and any other material. Further, die 15 may comprise a silicon substrate.

Die 15 is situated in a "snout" portion of the illustrated fluid ejection device 5, however it can be in another location. Die 15 includes a plurality of nozzles comprising one or more columns of openings or orifices 25. Although not expressly shown, each orifice 25 is fluidly coupled to a chamber which is heated by heating elements located on or within die 15.

One or more contact pads 35, designed to interconnect with electrodes to a device, e.g. a printer where the fluid ejection device is a print cartridge, that operates fluid ejection device 5, are formed on a front surface of flexible circuit 30. Each of contact pads 35 terminates one end of various conductive traces (not shown) formed on a back surface of flexible circuit 30 using a conventional photolithographic etching and/or plating process. Contact pads 35 and the conductive traces cooperate to provide externally generated signals and power to die 15.

Windows 40 and 45 extend through flexible circuit 30 and are used to facilitate bonding of the other ends of the conductive traces to electrodes on the silicon substrate containing heating resistors. Windows 40 and 45 are filled with an encapsulant to protect any underlying portion of the conductive traces and the substrate.

Flexible circuit 30 is conformed over a wall 50 of the fluid ejection device 5 and extends approximately one half the length of wall 50. This portion of flexible circuit 30 is needed for the routing of conductive traces which are connected to the substrate electrodes through the far end window 40. In particular, conductive traces, connected to contact pads 35, are routed over the bend and then connected to the substrate electrodes through windows 40 and 45 in flexible circuit 30.

Die 15 has a number of operating parameters that are used to operate the individual fluid ejection elements that are fabricated as part of die 15. These parameters include, but are not limited to, operating voltages sufficient to cause a fluid ejection element to eject fluid, the characteristics of the fluid in fluid reservoir 10, operating frequency, the type of fluid that fluid ejection device 5 is configured to eject, the protocol of signals that are required to eject fluid from the fluid ejection elements, and the device or slot in a device that the die is to be operated. In the case of an ink jet printer, such parameter may include pen model, ink color, ink fill, the printer and chute in the printer into which the pen is to be inserted and other parameters.

Figure 2:
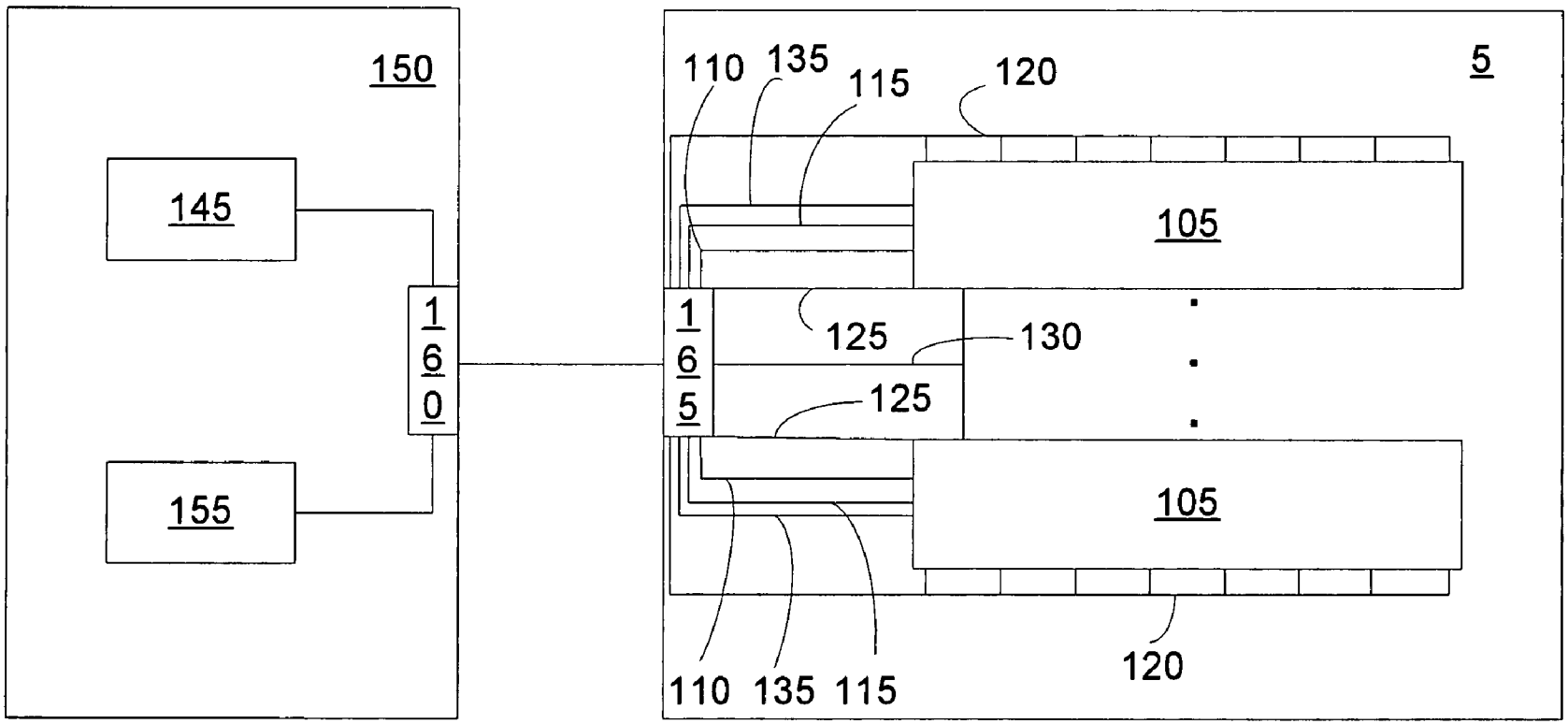
FIG. 2 illustrates a simplified block diagram of a fluid ejection device and a controller coupled with the fluid ejection device according to one embodiment.

FIG. 2 illustrates a simplified block diagram of a fluid ejection device 5 and controller 150. In fluid ejection device 5, one, or possibly more, fluid ejection elements that are arranged in groups 105, e.g. here depicted as rows. In one embodiment there are eight groups 105 on a die 15 of a fluid ejection device 5.

Each fluid ejection element in a group 105 may be a thermal ejection element, e.g. a heater resistor that vaporizes ink in a chamber to form drops is as well known. Each fluid ejection element in a group is coupled to a common first address line 110, second address line 115, select line 125, pre-charge line 130, and fire line 135. However, each fluid ejection element in group 105 is coupled to a different data line 120. In this embodiment, there are six groups 105 and therefore there are six first address lines 110, second address lines 115, fire lines 135, while there are seven select lines 125.

In operation, one or more fluid ejection elements eject ink based upon a protocol that specifies the order and timing of signals provided on common first address line 110, second address line 115, data line 120, select line 125, pre-charge line 130, and fire line 135. For example, one embodiment of a protocol for operating a fluid ejection device, such as fluid ejection device 5 includes first charging a fluid ejection element via pre-charge line 130. At approximately the same time an on-signal is provided on select line 125 to prepare the entire group 105 of fluid ejection elements 100 for ejecting fluid. Almost immediately after the on-signals provided on select line 125 and pre-charge line 130 are terminated, the address lines 110 and 115 and fire lines 135 are provided with an on-signal. During the time that an on-signal is provided address lines 110 and 115 and fire lines 135, an on-signal may be provided on a particular data line 120 for a particular fluid ejection element. In this embodiment, the on-signals on data lines 120 are provided sequentially during an on-signal provided on address lines 110 and 115 and fire lines 135. Other portions of a protocol, also determine when this sequence occurs for groups 105 with respect to other groups 105. The protocol may also determine the order in which the above protocol occurs for groups 105.

While the above paragraph describes a protocol for a fluid ejection device 5 that has first address line 110, second address line 115, data line 120, select line 125, pre-charge line 130, and fire line 135, the protocol and fluid ejection device can have the same number, greater, fewer, or even different such lines and still be compatible with the disclosure herein. The only requirement is that there are multiple groups 105 of fluid ejection elements with the fluid ejection elements of each group 105 are coupled by one or more lines.

Pull-down resistors are carried on each first address line 110, second address line 115, data line 120, select line 125, and fire line 135. Pull-down resistors are utilized to prevent the voltage potential of the lines from floating by pulling the voltage potential of the lines down to ground, unless a high voltage signal is applied to the line. When voltage on the line is high, a voltage drop forms over the pull-down resistor, and the electrical potential of the line is elevated.

In FIG. 2, controller 150 receives a controlled voltage from a power supply. Also, controller 150 receives data from the host system and processes the data into printer control information and image data. The processed data, image data and other static and dynamically generated data, is utilized to operate the fluid ejection elements and the other functionality of fluid ejection device 5.

Controller 150 includes test circuitry 145 and operating circuitry 155. Operating circuitry 155 controls and provides address line generation and conversion of data received by fluid ejection device 5 in order to properly eject fluid from the fluid ejection elements. A description of controller 150 and its operation with respect to operating circuitry 155 is depicted and disclosed in co pending U.S. patent application Ser. No. 10/670,061, entitled Variable Drive For Printhead, which is incorporated by reference in its entirety as if fully set forth herein.

Test circuitry 145 allows controller 150 to probe and measure various parameters and components of fluid ejection device 5. Test circuitry 145 may operate in a number of test modes, which allow it to test different components or aspects of operation of fluid ejection device 5. In some embodiments, controller can operate in four different test modes. One of the test modes, does not testing and allows fluid ejection 5 to perform standard fluid ejection operations. The other three test modes operate to test to determine the state of the pull-down resistors, the status of the address lines 110 and 115, and determine if fluid ejection device is properly operating, respectively. It should be noted that more or fewer test modes may be utilized, and the functionality of the above test modes may be divided into more or fewer test modes as well.

In FIG. 2, controller 150 and fluid ejection device are coupled to each other through interconnect circuits 160 and 165, respectively.

Figure 3:
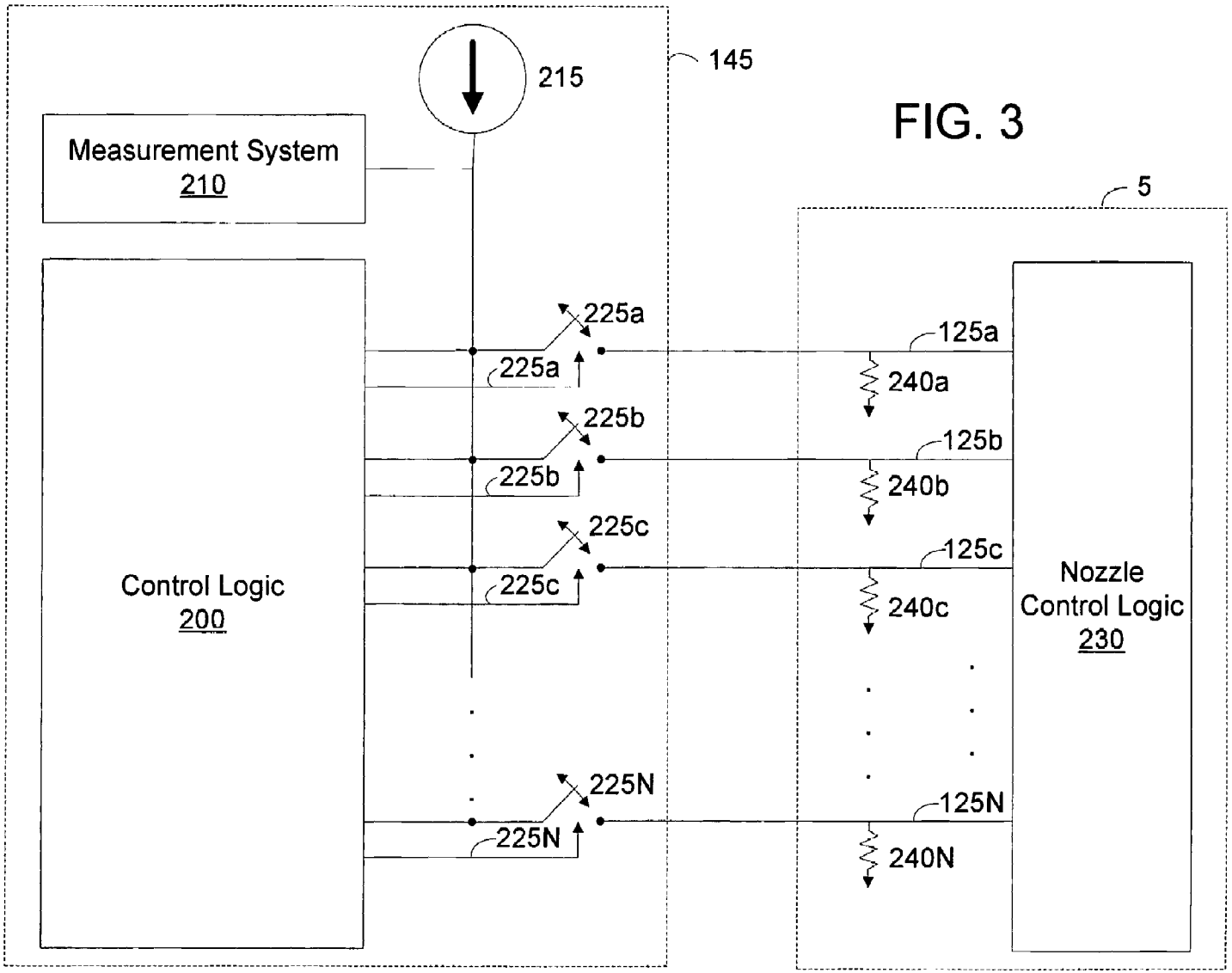
FIG. 3 illustrates a functional block diagram of pull-down resistors and components that are utilized to measure the magnitudes of the pull-down resistors according to one embodiment.

FIG. 3 illustrates a functional block diagram of components and pull-down resistors that are utilized to measure the magnitudes of the pull-down resistors according to one embodiment. In the embodiment of FIG. 3, control logic 200, amongst other things, operates switches 220*a* to 220N by sending control signals along control lines 225*a* to 225N, respectively. When switch 220*a* is conducting, e.g. when controller 150 is in a test mode and test circuitry 145 is operating, a current from current source 215 is provided along select line 125*a*, this current is shunted through pull-down resistor 240*a*. The voltage generated across pull-down resistor 240*a* is then determined by measurement circuitry 210 which determines the magnitude of pull-down resistor 240*a*. This process can be repeated for each of select lines 125*b* to 125N sequentially to gather N-bits of data, as in one embodiment where each pull-down resistor 240*a* to 240N has two possible states, a high resistance state and a low resistance state.

The select lines 125*a* to 125N are coupled to nozzle control logic 230 that includes the fluid ejection elements and is also coupled to first address lines 110, second address lines 115, data lines 120, pre-charge lines 130, and fire lines 135. In test mode, as depicted in FIG. 3, nozzle control logic 230 is instructed, by control logic 200 to prevent current flow to the fluid ejection elements. Therefore, the only path for current provided by current source 215 is through pull-down resistor 240*a* to 240N.

It should be noted that the order of measuring pull-down resistor 240*a* to 240N need not be in sequential order from select line 125*a* to 125N. The order may be any predetermined order that is programmed into control logic 200. Further, the actual number of pull-down resistor 240*a* to 240N that are used to encode information may vary to as needed. For example, if there are 10 possible protocols that the different fluid ejection devices, which can fit into a single chute, utilize to operate, then 4 pull-down resistors can be utilized to encode the necessary information. In one embodiment, if there are seven select lines 125, then 128 bits of information may be encoded, which allows multiple information to be encoded including, for example, protocols and operating voltages or currents.

In the embodiment of FIG. 3, prior to providing a current from current source 215 on a select line 125*a* to 125N, a low or non-operating voltage is applied on select lines 125*a* to 125N.

While the embodiment depicted in FIG. 3, depicts one pull-down resistor per select line 125, it should be noted that multiple resistances may be utilized to encode additional information. A system and method for providing multiple pull-down resistors to encode additional information is depicted and disclosed in U.S. Pat. No. 6,325,483 which is incorporated herein by reference in its entirety.

It should be noted that the actual resistance of pull-down resistor 240*a* to 240N can vary. In one embodiment the magnitude of the resistance is between ten thousand and fifty thousand ohms in a high resistance mode, while in a low resistance mode the resistance is closer to a hundred ohms.

Figure 4:
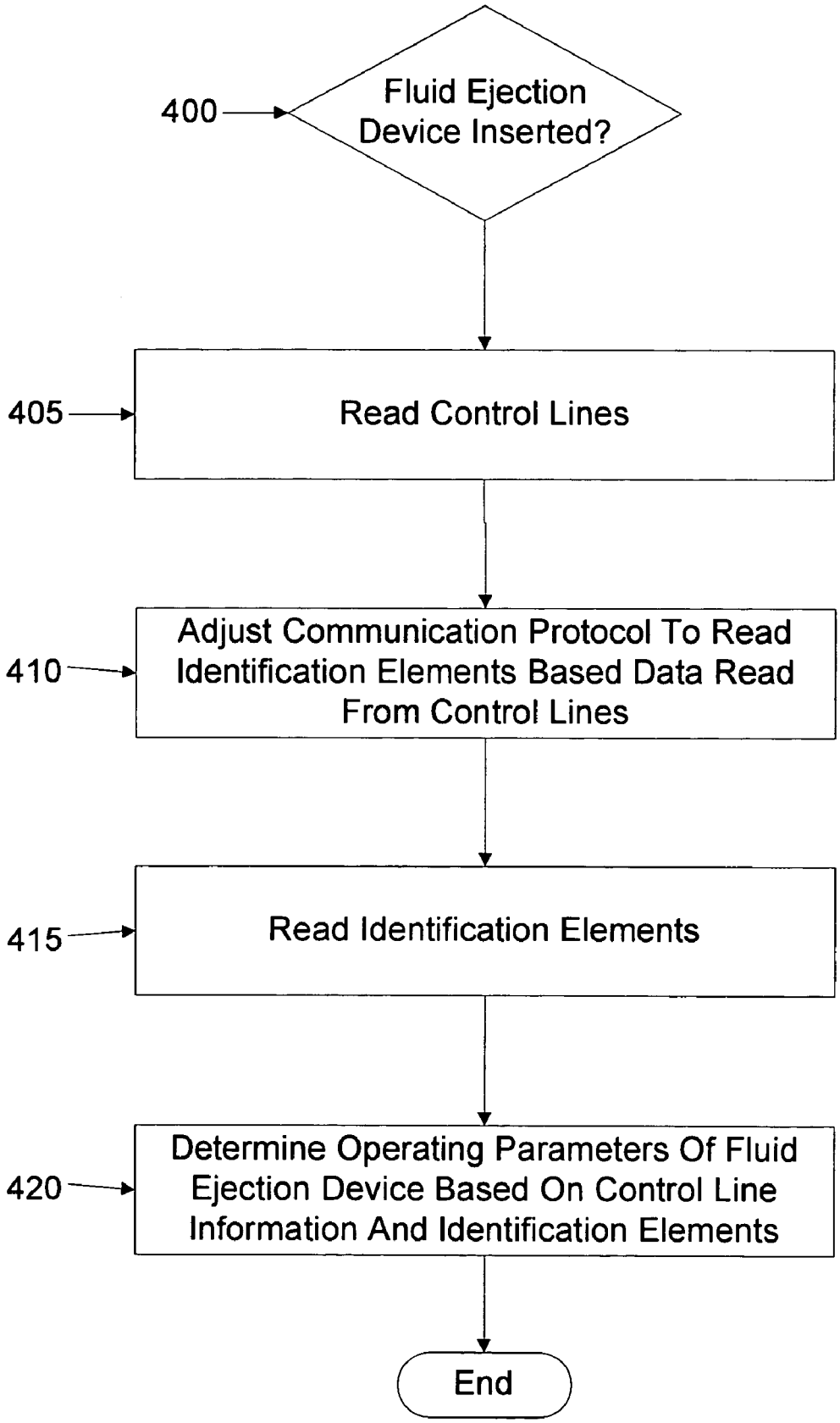
FIG. 4 illustrates a flow diagram of a process of obtaining identity information from a fluid ejection device according to one embodiment.

FIG. 4 illustrates a flow diagram of a process of identifying a fluid ejection device according to one embodiment. Controller 150 determines whether a fluid ejection device is inserted into one or more carriage chutes, step 400. In one embodiment, this occurs only if controller 150 has determined that the chute was previously empty or the device housing the fluid ejection device is being powered-on. In other embodiments, this determination can also be made prior to beginning fluid ejection, e.g. if the fluid ejection device is a printer, then at the beginning of a print job.

If controller 150 determines that a fluid ejection device has been inserted, then it reads identification information provided on control lines of the fluid ejection device, step 405. In one embodiment, the information is encoded in the magnitude of pull-down resistors on the control lines after the magnitude of a voltage on the control lines is brought to an "off" state, which in this embodiment is a voltage level below the threshold of the on-signals used to actuate the fluid ejection elements of the fluid ejection device.

The information encoded on the pull-down resistors may be information regarding the protocol for operating fluid ejection device 5. In one embodiment, where the fluid ejection device is a print cartridge, the encoded information may be indicative of whether the print cartridge is capable of operating according to a double data rate protocol, where the signals provided on common first address line 110, second address line 115, data line 120, select line 125, pre-charge line 130, and fire line 135 for each group 105 for each group are staggered slightly, i.e. during one cycle of operation at least one on-signal is able to be provided to each of the groups on each of the lines to that group while signals are also being provided on the lines of another group.

Alternatively, it is possible that the information provided by information encoded on the pull-down resistors is indicative of parameters for obtaining information from the identification elements of the fluid ejection device. In the example above, where the fluid ejection device is a print cartridge that operates at a double data rate, the information obtained from the pull-down resistors would be utilized as to set the rate at which signals are provided to obtain information from the identification elements of the printhead. Other information for obtaining information from the identification elements, e.g. regarding the position and voltage of signals for obtaining information from the identification elements, may also be encoded into the pull-down resistors.

Based upon the protocol information or other parameters for obtaining information from the identification elements that is obtained from the pull-down resistors, the protocol for communicating with the identification elements is altered, step 410. These alterations, may include, but are not limited to, the timing, sequence, and magnitude of signals that provided to and read from the identification elements.

After altering the protocol or other parameters, the identification elements of the fluid ejection device are queried, step 415. The identification elements may be any number of circuits or memory elements, such as random access memory elements. Examples of identification elements are depicted and described in U.S. Pat. Nos. 4,872,027, 5,363,614, 5,699,091, and 6,604,814, each of which are incorporated by reference in their entirety.

Once the identification information is obtained from the identification elements, controller 150 determines the necessary operating parameters of the fluid ejection device, step 415. The fluid ejection device can now be operated and the operation of the fluid ejection device can be monitored to be maintained within the desired operating parameters.

Figure 5:
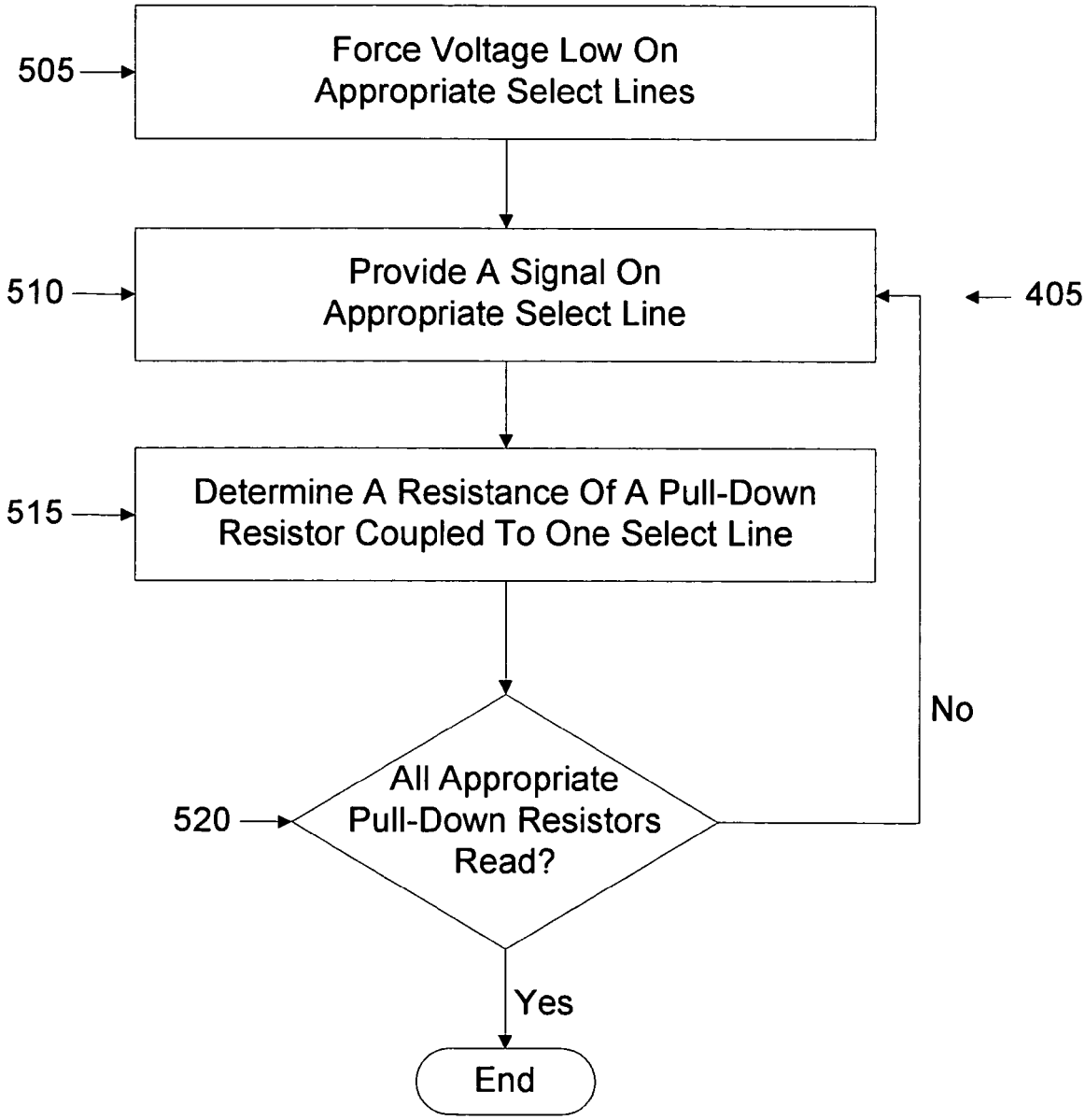
FIG. 5 illustrates a flow diagram of a process of determining identification values from control lines of a fluid ejection device according to one embodiment.

FIG. 5 illustrates a flow diagram of a process of determining identification values from control lines of a fluid ejection device according to one embodiment. The voltage on the control lines is forced low, step 500. The low voltage allows the pull-down resistors on the control lines to be at their initial values that were preset during manufacturing. In one embodiment, the low voltage is substantially equal to a magnitude of a voltage that is at the ground line that is coupled to the fluid ejection device.

Once the low voltage is applied, a signal is provided on one select line, step 510. In one embodiment, this signal is a current that is provided using a test mode of controller 150 as described with respect to FIG. 2. Based upon this signal, the resistance of one of the pull-down resistors coupled an appropriate one of the select lines is read, step 515. Then another signal, e.g. a current, is provided on another select line, until all of the appropriate pull-down resistors are read, step 520, In one embodiment, the magnitude of the resistance of each pull-down resistor is one bit of information regarding an operating parameter of the fluid ejection device. This allows for flexibility in encoding information onto the select lines. The number of select lines that are to be read can be any number needed to provide the necessary parameter. For example, if the only information encoded is the data rate of a print cartridge, then only one bit, e.g. provided by one pull-down resistor value, can be utilized. If more information is to be provided, the number of select lines to be read can be increased as needed.

It should be noted that while FIG. 5 describes determining values of pull-down resistors on select lines 125, other pull-down resistors may be encoded to contain the protocol or other information for obtaining information from the identification elements. For example, pull-down resistors located on address lines 110 and 115, data lines 120, and fire lines 135 can be encoded with information in addition or in lieu of the pull-down resistors on select lines 125.

Figure 6:
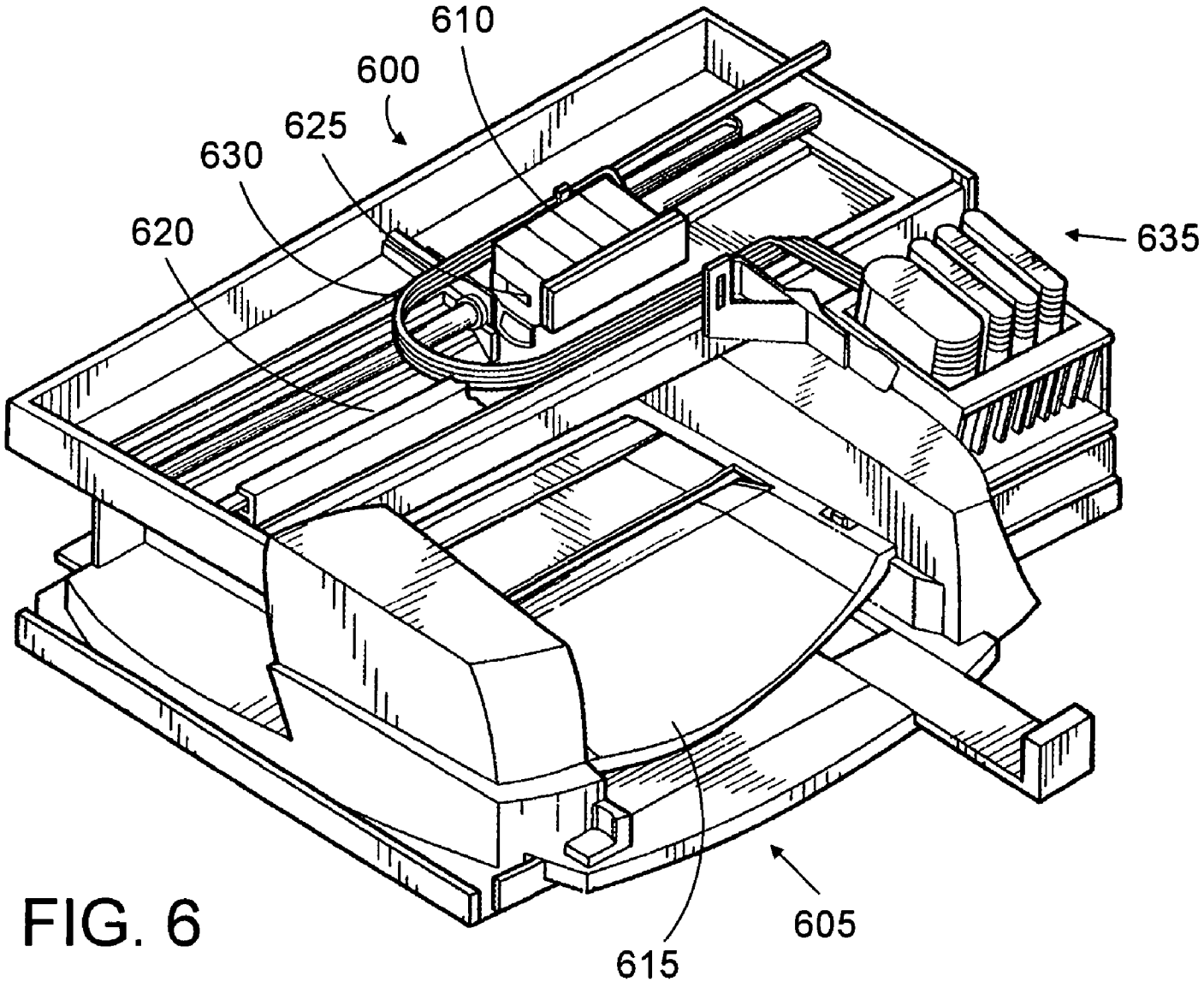
FIG. 6 illustrates a printer with a print cartridge according to one embodiment.

FIG. 6 illustrates a printer with a print cartridge according to one embodiment. Generally, printer 600 can incorporate a print cartridge 610, which is a type of fluid ejection device as described in FIGS. 1–4 above. Printer 600 can also include a tray 605 for holding print media. When a printing operation is initiated, print media, such as paper, is fed into printer 600 from tray 605 preferably using a sheet feeder (not shown). The sheet then brought around in a U direction and travels in an opposite direction toward output tray 615. Other paper paths, such as a straight paper path, can also be used. The sheet is stopped in a print zone 620, and a scanning carriage 625, supporting one or more print cartridges 610, is then scanned across the sheet for printing a swath of ink thereon. After a single scan or multiple scans, the sheet is then incrementally shifted using, for example, a stepper motor and feed rollers to a next position within the print zone 620. Carriage 625 again scans across the sheet for printing a next swath of ink. The process repeats until the entire sheet has been printed, at which point it is ejected into output tray 615.

The print cartridges 610 can be removeably mounted or permanently mounted to the scanning carriage 625. Also, the print cartridges 610 can have self-contained ink reservoirs (for example, the reservoir can be located within printhead assembly body, e.g. the embodiment of fluid ejection device 5 in FIG. 1.) The self-contained ink reservoirs can be refilled with ink for reusing the print cartridges 610. Alternatively, each print cartridge 610 can be fluidly coupled, via a flexible conduit 630, to one of a plurality of fixed or removable ink supplies 635 acting as the ink supply. As a further alternative, the ink supplies 635 can be one or more ink containers separate or separable from printhead assemblies.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A method for identifying a fluid ejection device comprising:

determining first identification information;

based upon the first identification information, querying one or more elements on a fluid ejection device that include second identification information, wherein the fluid ejection device is a print head and the first identification information comprises a data rate of operation of the print head;

determining the second identification information based upon the query;

determining a plurality of operating parameters of the fluid ejection device based upon the first and second identification information; and operating the fluid ejection device in accordance with at least some of the operating parameters.

2. The method of claim 1, wherein determining the first identification information comprises querying a portion of the fluid ejection device that controls operation of one or more fluid ejection elements.

3. The method of claim 2, wherein determining the first identification information comprises determining, in response to a current provided to a pull down resistor that is coupled to a line that is coupled to the one or more fluid ejection elements, a voltage magnitude at the pull down resistor.

4. The method of claim 2, wherein querying a portion of the fluid ejection device that controls operation of one or more fluid ejection elements comprises querying a first portion of the fluid ejection device that controls operation of a first group of elements and querying at least one other portion of the fluid ejection device that controls operation of a second group of elements.

5. The method of claim 2, wherein the first identification information is indicative of a protocol of the fluid ejection device and wherein querying one or more elements on the fluid ejection device that include second identification information comprises querying the identification elements based upon the protocol.

6. The method of claim 5, wherein the protocol is a double data rate protocol.

7. The method of claim 1, wherein determining the first identification information comprises determining a resistance value at a pull down resistor.

8. A method of identification of a fluid ejection device, comprising:

providing at least a first signal on one or more lines, the one or more lines coupled to one or more fluid ejection elements that eject fluid;

determining, responsive to the at least first signal, first identification information;

providing at least a second signal to one or more elements on the fluid ejection device that are configured to provide second identification information;

determining the second identification information responsive to at least the second signal; and determining a plurality of operating parameters of the fluid ejection device based upon the first and second identification information, wherein the fluid ejection device is a print head and the first identification information comprises a protocol for ejecting ink from the print head and a value of at least one pull down resistor; and operating the print head in accordance with at least some of the operating parameters so as to eject the fluid.

9. The method of claim 8, determining a value of at least one pull down resistor comprises determining a magnitude of a resistance of the at least one pull down resistor in response to a current provided on the line coupled with the at least one pull down resistor.

10. The method of claim 9, wherein determining a value of at least one pull down resistor comprises determining a voltage magnitude at the pull down resistor in response to a current provided to the at least one pull down resistor.

11. The method of claim 8, wherein the first identification information comprises a protocol of operation of the fluid ejection device and wherein providing at least a second signal to one or more elements on the fluid ejection device that are configured to provide second identification information comprises providing signals based upon the protocol.

12. A fluid ejection device, comprising:

a plurality of fluid ejection elements;

a plurality of identification elements;

a plurality of lines each coupled to a group of the plurality of fluid ejection elements; and a plurality of pull down resistors coupled to some of the plurality of lines, at least some of the plurality of pull-down resistors encoding information regarding a protocol for operating the plurality of fluid ejection elements, wherein the information regarding the protocol further comprises information that is indicative of parameters for providing signals to the identification elements.

13. The fluid ejection device of claim 12, wherein the fluid ejection device is coupled with a controller capable of determining a magnitude at each of the pull down resistors and determining the protocol based on the magnitude of at least some of the pull-down resistors.

14. The fluid ejection device of claim 13, wherein the controller is capable of determining a magnitude of a resistance of each of the pull down resistors.

15. The fluid ejection device of claim 12, wherein each of the plurality of pull down resistors has at least a first magnitude and a second magnitude, and wherein the first magnitude is indicative of the at least one operating parameter of the fluid ejection device.

16. The fluid ejection device of claim 12, wherein the plurality of lines comprise select lines.

17. The fluid ejection device of claim 12, wherein the plurality of lines comprise address lines.

18. The fluid ejection device of claim 12, wherein the plurality of lines comprise fire lines.

19. The fluid ejection device of claim 12, wherein the plurality of lines comprise data lines.

20. The fluid ejection device of claim 12, wherein the fluid ejection device is a print head.

21. A fluid ejection device comprising:

a plurality of fluid ejection elements;

a plurality of identification elements;

a plurality of lines each coupled to a group of the plurality of fluid ejection elements; and an encoder for encoding information regarding a protocol of operating the fluid ejection elements, the encoder coupled to at least some of the plurality of lines, wherein the information regarding the protocol further comprises information for providing signals to the identification elements, wherein the encoder changes from a first state to a second state based upon signals received from a controller.

22. The fluid ejection device of claim 21, wherein the plurality of lines comprise select lines.

23. The fluid ejection device of claim 21, wherein the plurality of lines comprise address lines.

24. The fluid ejection device of claim 21, wherein the plurality of lines comprise fire lines.

25. The fluid ejection device of claim 21, wherein the plurality of lines comprise data lines.

* * * * *